US008506656B1

(12) United States Patent
Turocy

(10) Patent No.: US 8,506,656 B1
(45) Date of Patent: Aug. 13, 2013

(54) SYSTEMS AND METHODS FOR PRODUCING FUEL COMPOSITIONS

(75) Inventor: Gregory Turocy, Moreland Hills, OH (US)

(73) Assignee: Gregory Turocy, Moreland Hills, OH (US)

( * ) Notice: Subject to any disclaimer, the term of this patent is extended or adjusted under 35 U.S.C. 154(b) by 0 days.

(21) Appl. No.: 13/397,930

(22) Filed: Feb. 16, 2012

Related U.S. Application Data

(60) Continuation of application No. 12/974,147, filed on Dec. 21, 2010, now Pat. No. 8,147,570, and a continuation of application No. 12/505,745, filed on Jul. 20, 2009, now Pat. No. 7,879,118, and a division of application No. 10/863,419, filed on Jun. 8, 2004, now Pat. No. 7,585,337, and a continuation of application No. 10/201,346, filed on Jul. 23, 2002, now Pat. No. 7,540,887.

(51) Int. Cl.
*C10L 1/18* (2006.01)

(52) U.S. Cl.
USPC ..... 44/300; 44/451

(58) Field of Classification Search
USPC ..... 44/300, 451
See application file for complete search history.

(56) References Cited

U.S. PATENT DOCUMENTS

| | | | | |
|---|---|---|---|---|
| 3,557,487 | A | 1/1971 | Crespin et al. | |
| 5,225,679 | A * | 7/1993 | Clarke et al. | 250/343 |
| 5,288,393 | A | 2/1994 | Jessup et al. | |
| 5,572,030 | A | 11/1996 | Ranson et al. | |
| 5,654,497 | A | 8/1997 | Hoffheins et al. | |
| 5,837,126 | A | 11/1998 | Jessup et al. | |
| 5,904,836 | A | 5/1999 | Lee et al. | |
| 6,007,589 | A | 12/1999 | Talbert | |
| 6,030,521 | A | 2/2000 | Jessup et al. | |
| 6,172,272 | B1 | 1/2001 | Shabtai et al. | |
| 6,258,987 | B1 | 7/2001 | Schmidt et al. | |
| 6,290,734 | B1 | 9/2001 | Scott et al. | |
| 6,314,944 | B1 * | 11/2001 | Majima | 123/491 |
| 6,328,772 | B1 | 12/2001 | Scott et al. | |
| 6,383,236 | B1 | 5/2002 | Welstand et al. | |

FOREIGN PATENT DOCUMENTS

WO 99/49003 9/1999

OTHER PUBLICATIONS

U.S. Office Action for U.S. Appl. No. 10/201,346 mailed on Jun. 30, 2008.
U.S. Office Action for U.S. Appl. No. 10/863,419 mailed on Jul. 1, 2008.
U.S. Office Action for U.S. Appl. No. 10/201,346 mailed on Aug. 10, 2005.
U.S. Office Action for U.S. Appl. No. 10/201,346 mailed on Jan. 27, 2006.
U.S. Office Action for U.S. Appl. No. 10/201,346 mailed on May 8, 2006.
U.S. Office Action for U.S. Appl. No. 10/201,346 mailed on Jul. 28, 2006.
U.S. Office Action for U.S. Appl. No. 10/201,346 mailed on Dec. 21, 2006.
U.S. Office Action for U.S. Appl. No. 10/201,346 mailed on Jul. 30, 2008.
U.S. Office Action for U.S. Appl. No. 10/863,419 mailed on Sep. 24, 2007.

* cited by examiner

*Primary Examiner* — Cephia D Toomer
(74) *Attorney, Agent, or Firm* — Turocy & Watson, LLP

(57) ABSTRACT

Methods for producing fuel compositions with predetermined desirable properties are disclosed. Feedback control can be employed to meter precise amounts of fuel composition components while monitoring fuel composition properties to obtain fuel compositions having specifically defined properties.

20 Claims, 5 Drawing Sheets

SYSTEMS AND METHODS FOR PRODUCING FUEL COMPOSITIONS

CROSS-REFERENCE TO RELATED APPLICATIONS

This application is a Continuation of application Ser. No. 12/974,147 filed on Dec. 21, 2010, now U.S. Pat. No. 8,147,570, which is a Continuation of application Ser. No. 12/505,745 filed on Jul. 20, 2009, now U.S. Pat. No. 7,879,118, which is a Division of application Ser. No. 10/863,419 filed on Jun. 8, 2004, now U.S. Pat. No. 7,585,337, which is a Continuation of application Ser. No. 10/201,346 filed on Jul. 23, 2002, now U.S. Pat. No. 7,540,887, the entire contents of all of which are incorporated herein by reference.

FIELD OF THE INVENTION

The present invention generally relates to methods and systems for producing fuel compositions. In particular, the present invention relates to methods and systems for producing fuel compositions with predetermined desirable properties.

BACKGROUND OF THE INVENTION

One of the major environmental problems confronting the United States and other countries is pollution caused by the emission of gaseous and other pollutants in the exhaust gases from internal combustion engines such as automobiles. This problem is especially acute in areas having a high concentration of internal combustion engines, such as in major metropolitan areas.

It is known that at least three gaseous constituents or pollutants, which contribute to pollution due to engine exhaust are nitrogen oxides (NOx), carbon monoxide (CO), and unburned or incompletely burned hydrocarbons (i.e., hydrocarbon components originally present in the gasoline fuel which are not fully converted to carbon monoxide or dioxide and water during combustion in the automobile engine).

As a result of pollution caused by the internal combustion engine, laws and regulations have been established to mitigate pollution by reducing gaseous constituents or pollutants by controlling the composition of gasoline fuels. Such specially formulated, low emission gasolines are often referred to as reformulated gasolines. One of the requirements of these gasoline regulations is blending, in certain geographic areas, certain additives, such as oxygen-containing hydrocarbons, or oxygenates, into the fuel.

Oxygenated gasoline is a mixture of conventional hydrocarbon-based gasoline and one or more oxygenates. Oxygenates are combustible liquids which are made up of carbon, hydrogen and oxygen. Generally, the current oxygenates used in reformulated gasolines belong to one of two classes of organic molecules: alcohols and ethers.

There are concerns associated with the use of oxygenates in fuel. Therefore, cleaner burning gasoline without oxygenates are a possibility.

SUMMARY OF THE INVENTION

The present invention relates to methods and systems for making fuel compositions, particularly gasoline fuels, in an efficient manner by using feedback control to obtain desired properties. Feedback control can be employed to meter precise amounts of feed stream components and additives in response to current properties to obtain fuel compositions having specifically defined properties. In this connection, an efficient, closed loop, automated system for making fuel compositions having predetermined, desired properties. Moreover, the methods and systems can provide fuel compositions which, upon combustion, mitigate the release of CO, NOx, and/or hydrocarbon emissions to the atmosphere.

One aspect of the invention relates to a system for making a fuel composition containing a delivery system for providing fuel composition components to a blending tank, the delivery system containing one or more hydrocarbon feedstock, optionally one or more oxygenate feedstock, and optionally one or more additive feed; a fuel composition property monitor for determining at least one fuel composition property; and a controller for controlling amounts of fuel composition components provided to the blending tank by the delivery system based upon at least one fuel composition property.

Another aspect of the invention relates to automated method of making a fuel composition, involving identifying one or more predetermined properties of the fuel composition; charging one or more hydrocarbon feedstock, optionally one or more oxygenate feedstock, and optionally one or more additives into a blending tank, each of the one or more hydrocarbon feedstock, one or more oxygenate feedstock, and one or more additive feed having a charge rate; determining one or more current properties of the fuel composition mixture; comparing the predetermined properties of the fuel composition with the current properties of the fuel composition mixture; and adjusting the charge rate of at least one of the one or more hydrocarbon feedstocks, one or more oxygenate feedstocks, and one or more additives in response to the comparison to provide the fuel composition.

DETAILED DESCRIPTION OF THE INVENTION

Figure 1:
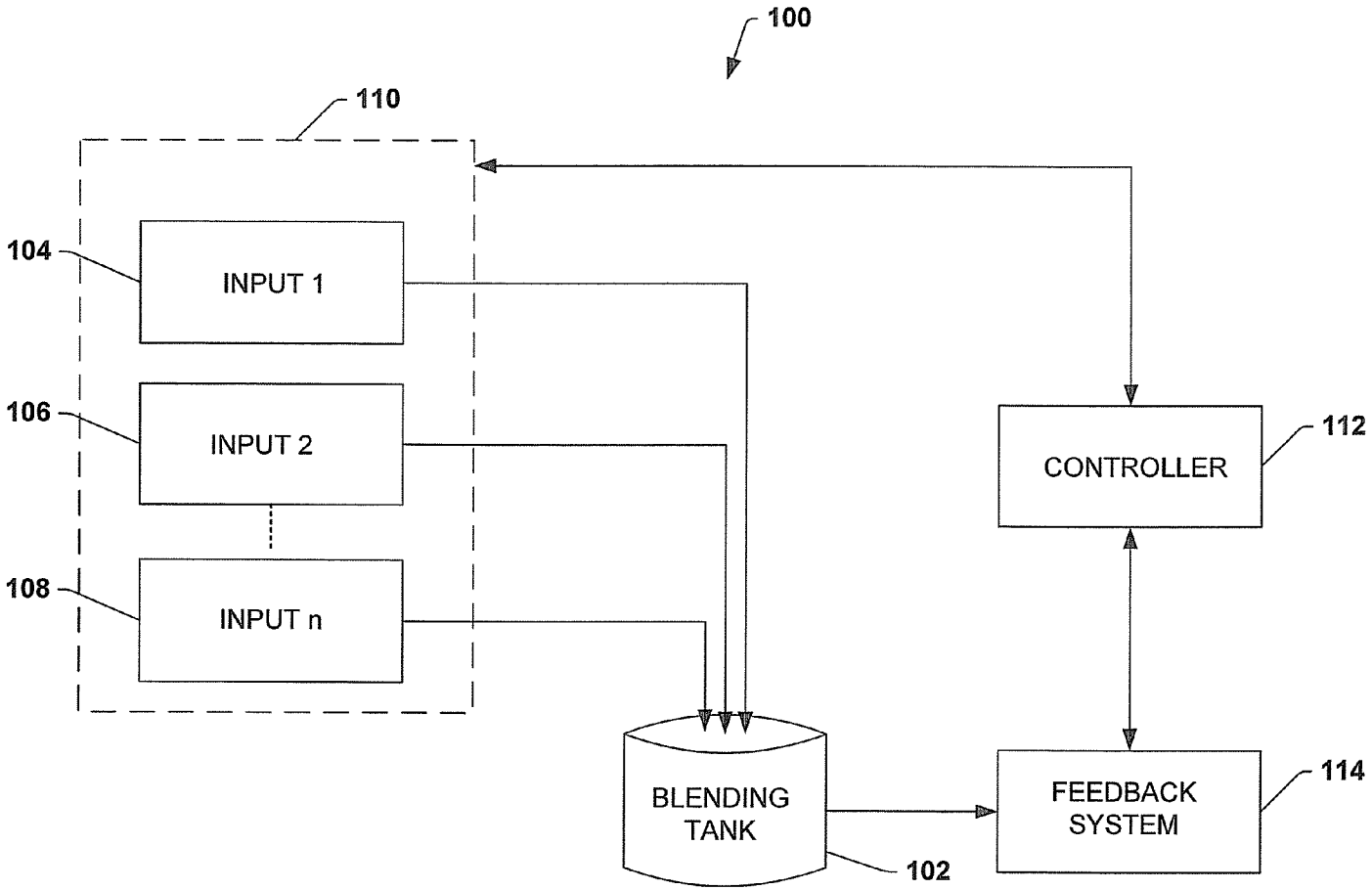
FIG. 1 illustrates an example of a high level schematic block diagram of a system for making a fuel composition in accordance with an aspect of the present invention.

Fuel compositions in accordance with the present invention are made by combining one or more hydrocarbon feedstocks, optionally one or more oxygenate feedstocks, and optionally one or more additives. The fuel compositions are typically combined by blending the various feedstocks/streams and additives to obtain a substantially homogenous mixture. Fuel compositions are generally composed of a mixture of numerous hydrocarbons having different boiling points at atmospheric pressure. Thus, a fuel composition boils or distills over a range of temperatures, unlike a pure compound. In general, a fuel composition distills over the range of from about room temperature to about 440° F. This temperature range is approximate and the exact range depends on the refinery feed streams used to make the fuel composition and the environmental requirements for the resultant fuel composition. Fuel compositions typically contain aromatics, olefins, and paraffins, optionally an oxygen containing compound, i.e., an oxygenate, and optionally one or more of various additives.

Examples of hydrocarbon feedstocks that may be employed to form fuel compositions include straight-run products, reformate, cracked gasoline, high octant stock, isomerate, polymerization stock, alkylate stock, hydrotreated feedstocks, desulfurization feedstocks, and the like. When forming a fuel composition, one or more hydrocarbon feedstocks can be employed, two or more hydrocarbon feedstocks can be employed, three or more hydrocarbon feedstocks can be employed, four or more hydrocarbon feedstocks can be employed, and so on.

Straight-run products, such as naphthas and kerosene, are obtained from distillation of crude oil. A reformer converts naphthas and/or other low octane gasoline fractions into higher octane stocks, such as converting straight chain paraffins into aromatics. Reformate contains these higher octane stocks. Cracked gasoline, the product of cracking, contains lower boiling hydrocarbons made by breaking down hydrocarbons with high boiling points. Cracking typically involves catalytic cracking and hydrocracking.

Isomerization converts and rearranges the molecules of straight chain paraffins (typically low octane hydrocarbons) into branched isomers (typically high octane hydrocarbons). Isomerate contains the products of isomerization. Polymerization stock contains polymerized olefins, the olefins often the product of cracking processes. Alkylate stock contain the products of alkylation. Alkylation involves combining small, gaseous hydrocarbons into liquid hydrocarbons. Hydrotreated feedstocks contain the products of hydrotreating. Hydrotreating involves diverse processes including the conversion of benzene to cyclohexane, aromatics to naphthas, and the reduction of sulfur and nitrogen levels. Processes that specifically reduce sulfur levels are often termed desulfurization.

Oxygenate feedstocks contain combustible liquids which are made up of carbon, hydrogen and oxygen. General examples of oxygenate feedstocks include those of alcohols and ethers. Specific examples of oxygenates include methanol, ethanol, methyl tertiary butyl ether (MTBE), tertiary amyl methyl ether (TAME), and ethyl tertiary butyl ether (ETBE), and the like. When forming a fuel composition, one or more oxygenate feedstocks can be employed, two or more oxygenate feedstocks can be employed, and so on.

Additives generally include gasoline-soluble chemicals that are mixed with fuel composition components to enhance or improve certain performance characteristics or to provide characteristics not inherent in the gasoline. Examples of additives include antioxidants, corrosion inhibitors, metal deactivators, demulsifiers, antiknock compounds, deposit control additives, anti-icing additives, dyes, drag reducers, detergents, octane enhancers such as tetraethyl lead and the like. One or more additive, two or more additives, three or more additives, four or more additives, and so on, can be added to the fuel composition.

Antioxidants are typically aromatic amines and hindered phenols. Antioxidants prevent gasoline components from reacting with oxygen in the air to form peroxides or gums. Corrosion inhibitors are typically carboxylic acids and carboxylates. Corrosion inhibitors prevent free water in fuel compositions from rusting or corroding tanks and pipes. Metal deactivators are typically chelating agents, chemical compounds which capture specific metal ions. More-active metals, like copper and zinc, effectively catalyze the oxidation of gasoline. Metal deactivators inhibit their catalytic activity. Demulsifiers are typically polyglycol derivatives. A gasoline-water emulsion can be formed when gasoline passes through the high-shear field if the gasoline is contaminated with free water. Demulsifiers improve the water separating characteristics of gasoline by preventing the formation of stable emulsions. Antiknock compounds increase the antiknock quality of gasoline. Dyes are oil-soluble solids and liquids used to visually distinguish batches, grades, or applications of gasoline products. Drag reducers are typically high-molecular-weight polymers that improve the fluid flow characteristics of low-viscosity petroleum products.

Specific and precise amounts of one or more hydrocarbon feedstocks, optionally one or more oxygenate feedstocks, and optionally one or more additives are combined in order to obtain one or more predetermined desired properties in the resultant fuel composition. Examples of the desired fuel composition properties include aromatic hydrocarbon content (amount of aromatic hydrocarbons in the fuel composition); paraffin content (amount of paraffins in the fuel composition); benzene content (amount of benzene in the fuel composition); olefin content (amount of olefins in the fuel composition); oxygen content (amount of actual oxygen in the fuel composition); oxygenate content (amount of combustible liquids which are made up of carbon, hydrogen and oxygen in the fuel composition); sulfur content (amount of actual sulfur in the fuel composition); D-86 Distillation Points such as 10% distillation temperature (the temperature at which 10% of the fuel composition evaporates), 50% distillation temperature (the temperature at which 50% of the fuel composition evaporates), and 90% distillation temperature (the temperature at which 90% of the fuel composition evaporates); Reid Vapor Pressure (RVP); boiling point; Research Octane Number (RON); specific gravity; latent heat of evaporation; lead content; anti-knock value; and the like.

When forming a fuel composition, one or more fuel composition property is monitored, two or more fuel composition properties are monitored, three or more fuel composition properties are monitored, four or more fuel composition properties are monitored, five or more fuel composition properties are monitored, six or more fuel composition properties are monitored, seven or more fuel composition properties are monitored, and so on.

Additional predetermined desired properties, not mentioned herein or heretofore undefined, may be considered in employing the present invention. As used herein, "predetermined" means selected or identified beforehand. For example, before making a given fuel composition, it may be predetermined that a resultant fuel composition having a RVP of not more than about 7.25 psi is desired.

The hydrocarbon feedstocks, oxygenate feedstocks, and additives are combined while constantly or intermittently monitoring at least one desired property, and using the information generated by monitoring the mixing process to combine precise amounts of the individual hydrocarbon feedstocks, oxygenate feedstocks, and additives to provide a fuel composition having desired properties. Examples of fuel compositions made in accordance with the present invention include gasoline, reformulated gasoline, oxygenated gasoline, non-oxygenated gasoline, gasohol, leaded fuel, unleaded fuel, fuel oil, diesel fuel, jet fuel, and the like.

When blending components in accordance with the present invention to make a fuel composition such as gasoline, it is often desirable to control certain chemical and/or physical properties. For example, it is often desirable to vary the amount of individual components blended to one or more of increase, maintain, or decrease, but typically decrease the 50% D-86 Distillation Point; increase, maintain, or decrease, but typically decrease the olefin content; increase, maintain, or decrease, but typically increase the paraffin content; increase, maintain, or decrease, but typically decrease the RVP; increase, maintain, or decrease, but typically increase the RON; increase, maintain, or decrease, but typically decrease the 10% D-86 Distillation Point; increase, maintain, or decrease, but typically decrease the 90% D-86 Distillation Point; increase, maintain, or decrease, but typically increase the anti-knock value; and increase, maintain, or decrease, but typically increase the aromatic content. Generally speaking, controlling the chemical and/or physical properties described above can lead to greater resulting benefits in reducing emissions of one or more of CO, NOx, and hydrocarbons from gasoline run combustion engines.

In one embodiment, when monitoring the 50% D-86 distillation point of a fuel composition, the value usually is no greater than about 225° F. In other embodiments, the 50% D-86 distillation point is one of no greater than about 220° F., no greater than about 215° F., less than about 210° F., less than about 205° F., less than about 200° F., less than about 195° F., less than about 190° F., less than about 185° F., and less than about 183° F. In one embodiment, the 50% D-86 Distillation Point is above about 170° F. In another embodiment, the 50% D-86 Distillation Point is above about 180° F.

In one embodiment, when monitoring the 90% D-86 distillation point of a fuel composition, the value usually is no greater than about 340° F. In other embodiments, the 90% D-86 distillation point is one of no greater than about 330° F., no greater than about 320° F., less than about 315° F., less than about 305° F., less than about 300° F., and less than about 295° F.

In one embodiment, when monitoring or varying the olefin content, the value is maintained about 15 volume % or less. In other embodiments, the olefin content is maintained about 13 volume % or less, about 10 volume % or less, about 8 volume % or less, about 5 volume % or less, about 2 volume % or less, about 1 volume % or less, about 0.5 volume % or less, and essentially zero.

In one embodiment, when monitoring or varying the oxygenate content, the value is maintained about 15 volume % or less. In other embodiments, the oxygenate content is maintained about 10 volume % or less, about 8 volume % or less, about 6 volume % or less, about 4 volume % or less, about 2 volume % or less, and essentially zero.

In one embodiment, when monitoring or varying the sulfur content, the value is maintained less than about 30 ppmw. In other embodiments, the sulfur content is maintained below about 20 ppmw, and 10 ppmw.

In one embodiment, when monitoring the Reid Vapor Pressure, the value is maintained at about 8.0 psi or less. In other embodiments, the Reid Vapor Pressure is maintained at about 7.5 psi or less, about 7.0 psi or less, and about 6.5 psi or less.

In one embodiment, when monitoring the 10% D-86 Distillation Point, the value is maintained at about 140° F. or less. In other embodiments, the 10% D-86 Distillation Point is maintained at about 135° F. or less, about 130° F. or less, and about 122° F. or less.

In one embodiment, when monitoring or varying the paraffin content, the value is maintained above about 40 volume %. In other embodiments, the paraffin content is maintained above about 50 volume %, above about 65 volume %, above about 70 volume %, above about 75 volume %, above about 80 volume %, above about 85 volume %, and above about 90 volume %.

In one embodiment, when monitoring or varying the aromatics content, the value is maintained above about 30 volume %. In other embodiments, the aromatics content is maintained above about 35 volume %, and above about 40 volume %.

In one embodiment, when monitoring the RON, the value is maintained at about 90 or higher. In other embodiments, the RON is about 92 or higher, and 94 or higher. In one embodiment, when monitoring the anti-knock value, the value is maintained at about 86 or higher. In other embodiments, the anti-knock value about 87 or higher, about 89 or higher, about 90 or higher, and about 92 or higher.

In one embodiment, the system and method of the present invention monitor the Reid Vapor Pressure and the 50% D-86 Distillation Point. In another embodiment, the system and method of the present invention monitor the olefin content and the 10% D-86 Distillation Point.

Referring to FIG. 1, a high level schematic block diagram illustrating an example of a system 100 for making a fuel composition is shown in accordance with an aspect of the present invention. The system 100 includes blending tank 102, a first input stream 104, a second input stream, and so on to an $n^{th}$ input stream 108, delivery system 110, a controller 112, and a feedback system 114. The feedback system 114 and the delivery system 110 are operatively coupled to the controller 112. The first input stream 104, a second input stream, and nth input stream 108 provide specific amounts of components to the blending tank 102 that constitute the resultant fuel composition.

The amounts of components provided to the blending tank 102 are governed by the delivery system 110 and the controller 112. That is, the delivery system 110 releases a certain amount of each of the first input stream 104, a second input stream, and $n^{th}$ input stream 108 to the blending tank 102, in response to a signal from the controller. The delivery system 110 also provides data such as component identity, quantity, and charge rate information to the controller 112.

The controller 112 can control the operation of the feedback system 114 in a desired manner, such as based on a time interval operation. The controller 112 also controls the operation of the delivery system 110 in a desired manner based on fuel composition property information from the feedback system 114 and component identity and quantity information from the delivery system 110.

The feedback system 114 is coupled to the blending tank 102. The feedback system 114 includes components capable of determining one or more properties of the composition in the blending tank 102, and providing this data or information to the controller 112. For example, the feedback system 114 may contain one or more of a Reid Vapor Pressure monitor, a sensor, a spectrometer, boiling point monitor, a gas phase chromatographer, a liquid phase chromatographer, 10% distillation temperature monitor, 50% distillation temperature monitor, 90% distillation temperature monitor, D-86 Distillation Point monitor, Research Octane Number monitor, specific gravity monitor, anti-knock monitor, latent heat of evaporation monitor, lead content monitor, and the like. The feedback system 114 draws a sample of the composition from the blending tank 102, analyzes the sample and generates information about one or more properties of the composition, then sends the information to the controller 112.

The controller 112 can include a processor, optionally coupled to a memory, a programmable logic circuit, and the like, that may be programmed or configured to control operation of the delivery system 110. The memory can store program code executed by the processor for carrying out the operating functions of the system 100 described herein. The memory may also serve as a storage medium for temporarily storing information from the delivery system 110 and/or feedback system 114. Information representing desirable or predetermined properties of a resultant fuel composition may be charged to the controller 112. For example, one or more of a specific Reid Vapor Pressure, a minimum anti-knock value, a maximum amount of oxygenates, D-86 Distillation Points, a maximum amount of lead, a maximum amount of sulfur, and the like, may be input into the controller 112.

As the first input stream 104, a second input stream, and $n^{th}$ input stream 108 send their respective components to the to the blending tank 102, the feedback system 114 is constantly analyzing samples of the combined composition from the blending tank 102, and sending information about one or more properties of the combined composition to the controller 112. In view of the component identity and quantity information provided by the delivery system 110, and in view of the information about one or more properties of the composition provided by the feedback system 114, the controller 112 controls the subsequent amount of each of the first input stream 104, a second input stream, and $n^{th}$ input stream 108 that is sent to the blending tank 102 so that the resultant fuel composition obtains or moves closer to the aforementioned desirable or predetermined properties.

An automated, in-line, closed loop system 100 for making a fuel composition having certain desirable properties is thus provided. The automated, in-line, closed loop system 100 for making a fuel composition having a desired Reid Vapor Pressure and a desired amount of oxygenate. Fuel compositions having any of the properties described herein can be obtained using the system 100.

Figure 2:
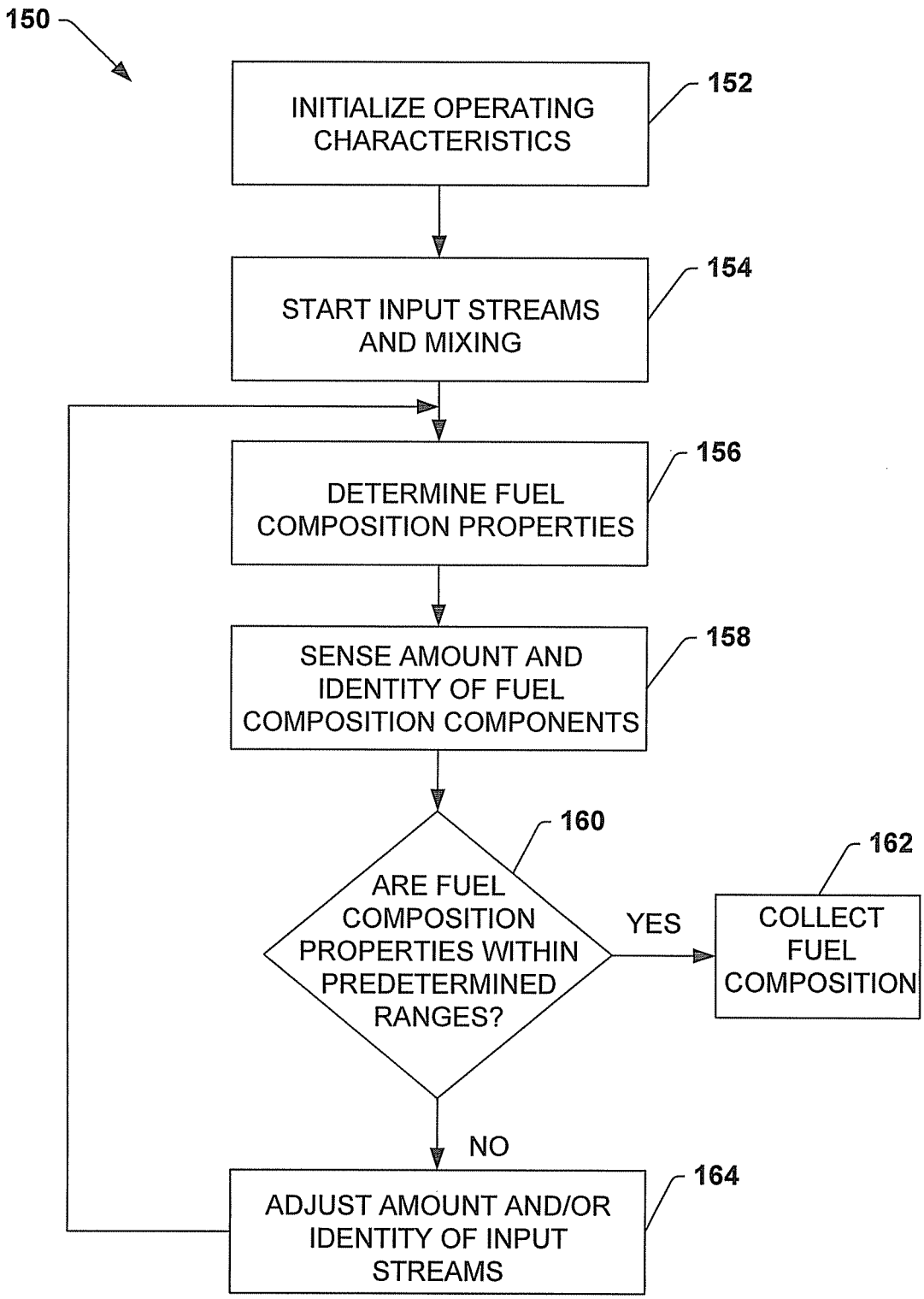
FIG. 2 shows a flow diagram of an exemplary methodology in accordance with an aspect of the present invention.

Referring to FIG. 2, a flow diagram of an exemplary methodology 150 for implementing the system 100 of FIG. 1 or another system in accordance with the present invention is shown. The process begins at 152 where operating characteristics are initialized. For example, predetermined or desirable fuel composition properties are identified, and the controller is configured to recognize the properties and stop, start, or alter input streams to achieve the properties or provide an altered fuel composition with properties closer to the desired properties. Initial flow rates may be set, and time intervals for determining fuel composition properties may be set.

At 154, valves are opened permitting one or more hydrocarbon feedstocks, optionally one or more oxygenate feedstocks, and optionally one or more additives to flow into a blending tank where all of the components are mixed. The components are mixed to reach and maintain a substantially uniform mixture.

At 156, one or more fuel composition properties are determined. Typically, this involves analyzing/monitoring a sample from the blending tank and generating data representing the characteristics of the fuel composition in the blending tank. For example, one or more of oxygen content, sulfur content, 10% distillation temperature, 50% distillation temperature, 90% distillation temperature, D-86 Distillation Point, Reid Vapor Pressure, boiling point, Research Octane Number, anti-knock value, specific gravity, latent heat of evaporation, lead content, and the like may be determined. This information is sent to a controller.

At 158, the amount and identity of each component sent to the blending tank, or present in the blending tank, is sensed by the controller. The amount and identity information may be sent to the controller by the delivery system or the feedback system. The delivery system can be equipped with flow meters to track the specific amounts of each component.

At 160, a determination is made as to whether one or more fuel composition properties are within or consistent with predetermined or desirable fuel composition properties. If the fuel composition properties are within or consistent with predetermined or desirable fuel composition properties, then the fuel composition is collected 162 and is suitable for delivery.

If one or more fuel composition properties are not within or not consistent with predetermined or desirable fuel composition properties, process control is adjusted 164, such as increasing/decreasing the rate or starting/stopping the flow of one or more of the hydrocarbon feedstocks, oxygenate feedstocks, and additives flowing into the blending tank. After the process is adjusted, a portion of the process is repeated 156, 158, and 160 until a desirable fuel composition is obtained.

Figure 3:
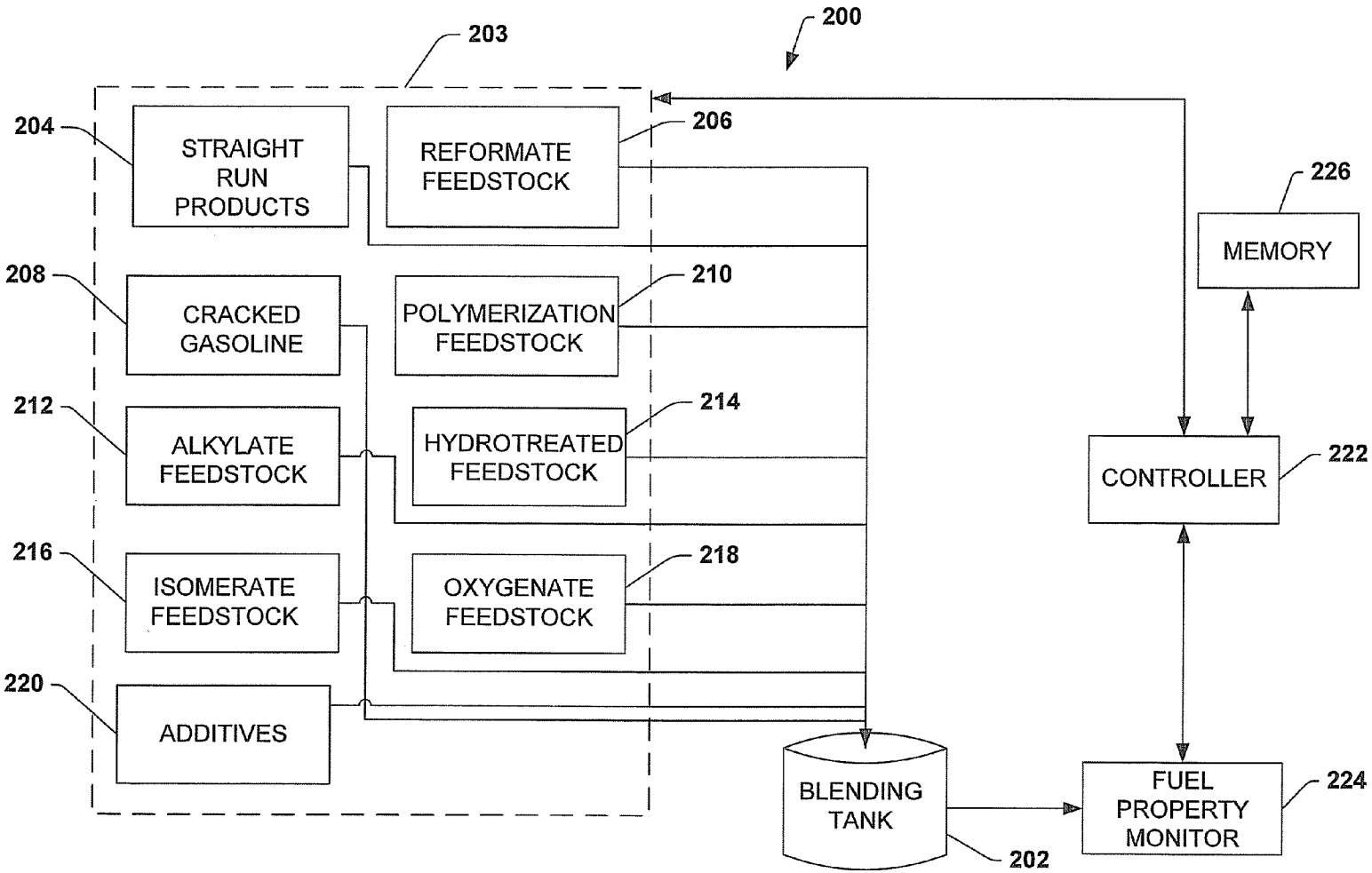
FIG. 3 illustrates an example of a schematic block diagram of another system for making a fuel composition in accordance with an aspect of the present invention.

Referring to FIG. 3, a schematic block diagram illustrating another example of a system 200 for making a fuel composition is shown in accordance with an aspect of the present invention. The system 200 includes blending tank 202, a delivery system 203, a controller 222, a memory 226, and a fuel property monitor 224. The fuel property monitor 224, the memory 226, and the delivery system 203 are operatively coupled to the controller 222. The delivery system 203 includes a straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220. The delivery system 203 includes a straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220 provide specific amounts of their respective components to the blending tank 202 that subsequently constitute the resultant fuel composition.

The amounts of components provided to the blending tank 202 are governed by the delivery system 203 and the controller 222. That is, the delivery system 203 releases a certain amount of each of the straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220 to the blending tank 202 in response to a signal from the controller 222. The delivery system 203 also provides component identity and quantity information to the controller 222.

The controller 222 can control the operation of the fuel property monitor 224 in a desired manner, such as based on a time interval operation, or in a continuous manner. The controller 222 also controls the operation of the delivery system 203 in a desired manner based on fuel composition property information from the fuel property monitor 224 and component identity and quantity information from the delivery system 203.

The fuel property monitor 224 is coupled to the blending tank 202. The fuel property monitor 224 includes components capable of determining one or more properties of the fuel composition in the blending tank 202, and providing this information to the controller 222. For example, the fuel property monitor 224 may contain a Reid Vapor Pressure monitor, a sensor, a spectrometer, boiling point monitor, 50% distillation temperature monitor, 90% distillation temperature monitor, D-86 Distillation Point monitor, Research Octane Number monitor, specific gravity monitor, latent heat of evaporation monitor, lead content monitor, and the like. The fuel property monitor 224 analyzes a sample of the fuel composition from the blending tank 202, generates information about one or more properties of the fuel composition, then sends the information to the controller 222.

The controller 222 can include a processor, a programmable logic circuit, and the like, coupled to a memory 226. The controller 222 may be programmed or configured to control operation of the delivery system 203. The memory 226 can store program code executed by the processor for carrying out the operating functions of the system 200 described herein. The memory may also serve as a storage medium for temporarily storing information from the delivery system 203 and/or the fuel property monitor 224. Historical information relating to amounts/identity of fuel composition components and corresponding properties, as well as the effect on fuel composition properties as the result of adding one or more components may also stored in the memory 226. Information representing desirable or predetermined properties of a resultant fuel composition may be charged to the controller 222. For example, one or more of a specific Reid Vapor Pressure, a maximum amount of oxygenates, the D-86 Distillation Point, a maximum amount of lead, a maximum amount of sulfur, and the like, may be input into the controller 222.

As the straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220 send their respective components to the to the blending tank 202, the fuel property monitor 224 is constantly or intermittently analyzing samples of the fuel composition from the blending tank 202, and sending information about one or more properties of the fuel composition to the controller 222. In view of the component identity and quantity information provided by the delivery system 203, and in view of the information about one or more properties of the fuel composition provided by the fuel property monitor 224, the controller 222 controls the subsequent amounts of each of the straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220 that are sent to the blending tank 202 so that the resultant fuel composition obtains or moves closer to the aforementioned desirable or predetermined properties.

For example, the fuel property monitor 224 measures the Research Octane Number and/or Reid Vapor Pressure of a sample of the fuel composition from the blending tank 202, and sends the measured values to the controller 222. The controller 222 may determine that the measured Research Octane Number and/or Reid Vapor Pressure are lower than the predetermined Research Octane Number and/or Reid Vapor Pressure. In this case, the controller 222 can send a signal to the delivery system 203 to increase the flow rate of one of straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220 and/or decrease the flow rate of one or more of straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220.

The delivery system 203 may contain or be coupled to a drive system (not shown) that facilitates metering specific amounts of one or more of straight run products stream 204, a reformate feedstock 206, a cracked gasoline source 208, a polymerization feedstock 210, an alkylate feedstock 212, a hydrotreated feedstock 214, an isomerate feedstock 216, an oxygenate feedstock 218, and an additive source 220.

Figure 4:
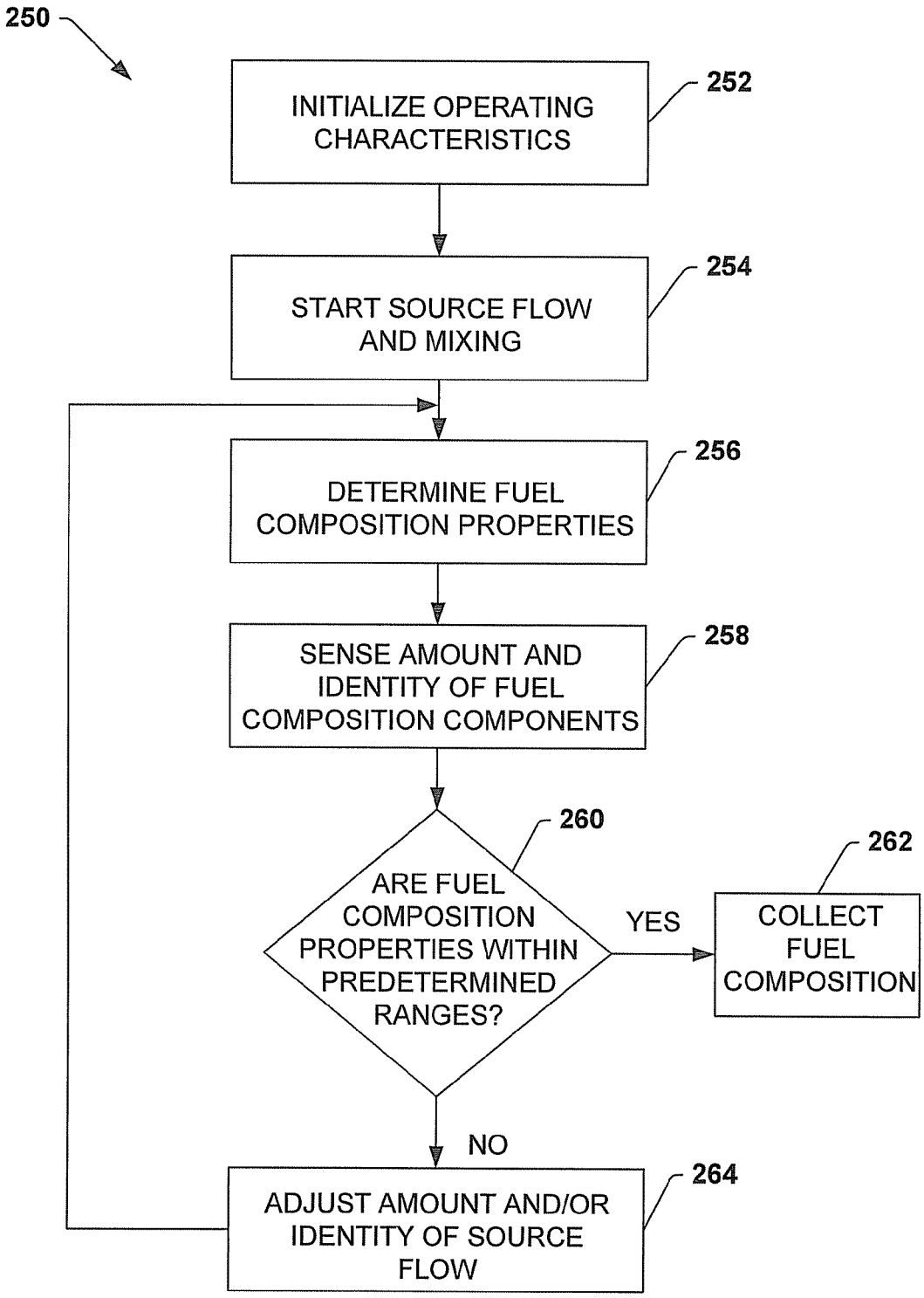
FIG. 4 shows a flow diagram of another exemplary methodology in accordance with an aspect of the present invention.

Referring to FIG. 4, a flow diagram of an exemplary methodology 250 for implementing the system 200 of FIG. 3 or another system in accordance with the present invention is shown. The process begins at 252 where operating characteristics are initialized. For example, predetermined or desirable fuel composition properties are identified, and the controller is configured to recognize the properties and stop, start, or alter the various source streams to the blending tank to achieve the desired properties. Initial flow rates may be set, and time intervals for determining fuel composition properties may also be set.

At 254, one or more of the straight run products stream, reformate feedstock, cracked gasoline source, polymerization feedstock, alkylate feedstock, hydrotreated feedstock, isomerate feedstock, oxygenate feedstock, and additive source are permitted to flow into a blending tank where all of the components are mixed. The various components are mixed to reach and maintain a substantially uniform mixture.

At 256, one or more fuel composition properties are determined. Typically, this involves analyzing/monitoring a sample of the fuel composition from the blending tank and generating data representing the characteristics or properties of the fuel composition. For example, one or more of oxygen content, sulfur content, 10% distillation temperature, 50% distillation temperature, 90% distillation temperature, D-86 Distillation Point, Reid Vapor Pressure, boiling point, Research Octane Number, specific gravity, anti-knock value, latent heat of evaporation, lead content, and the like may be determined. This information is sent to a controller.

At 258, the amount and identity of each component sent to the blending tank, or present in the blending tank, is sensed by the controller. The amount and identity information may be sent to the controller by the delivery system or the fuel property monitor system. The delivery system can be equipped with flow meters to track the specific amounts of each component.

At 260, a determination is made as to whether one or more fuel composition properties are within or consistent with predetermined or desirable fuel composition properties. If the fuel composition properties are within or consistent with predetermined or desirable fuel composition properties, then the fuel composition is collected 262 and is suitable for delivery.

If one or more fuel composition properties are not within or not consistent with predetermined or desirable fuel composition properties, process control is adjusted 264, such as increasing/decreasing the rate or starting/stopping the flow of one or more of the straight run products stream, reformate feedstock, cracked gasoline source, polymerization feedstock, alkylate feedstock, hydrotreated feedstock, isomerate feedstock, oxygenate feedstock, and additive source flowing into the blending tank. After the process is adjusted, a portion of the process is repeated 256, 258, and 260 until a desirable fuel composition is obtained.

Figure 5:
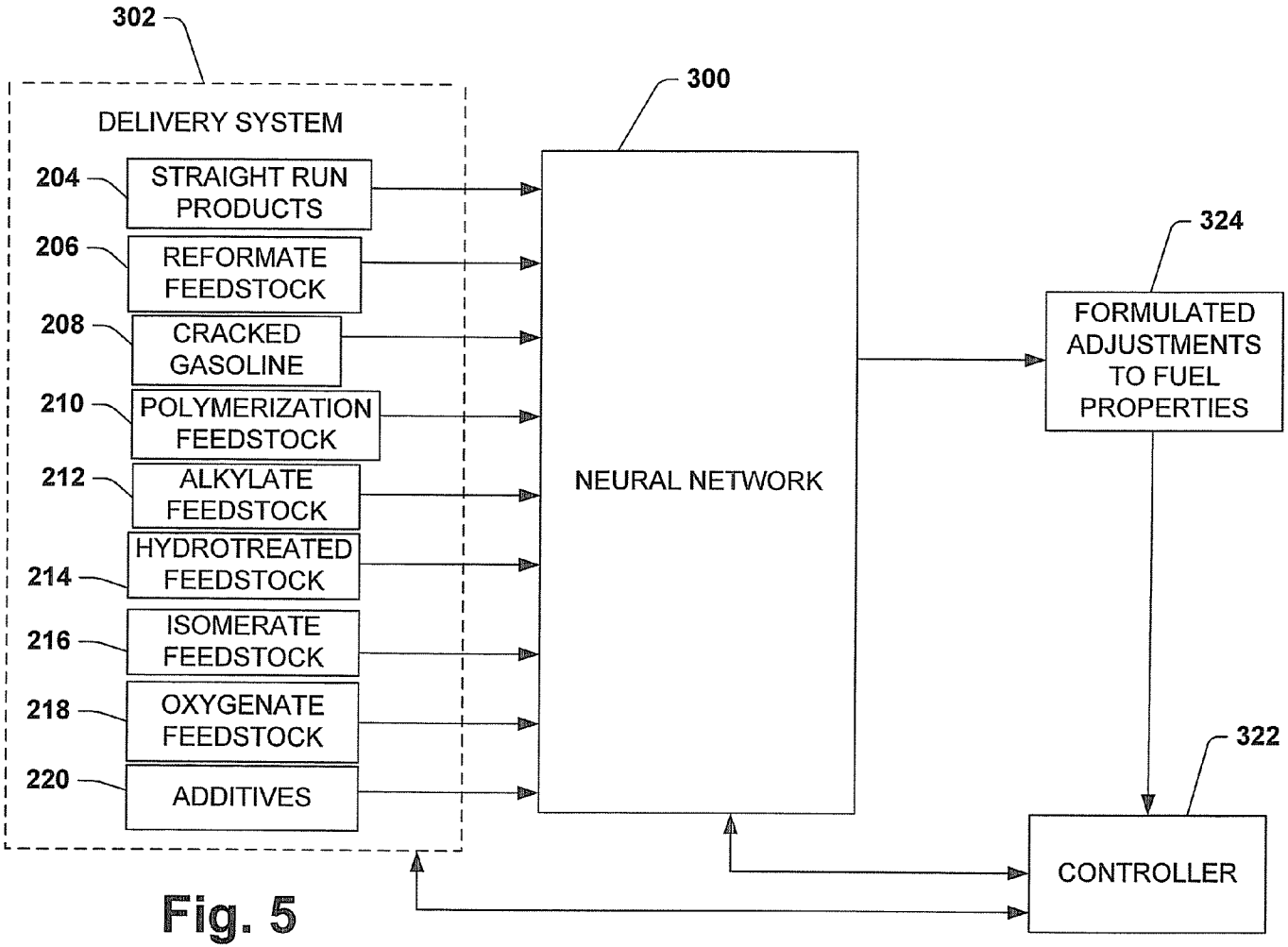
FIG. 5 illustrates a schematic block diagram of a neural network for making a fuel composition in accordance with an aspect of the present invention.

Referring to FIG. 5, the system of making a fuel composition in accordance with the present invention may also include a trained neural network (TNN) 300 for detecting fuel composition properties and directing within the one or more of straight run products stream, reformate feedstock, cracked gasoline source, polymerization feedstock, alkylate feedstock, hydrotreated feedstock, isomerate feedstock, oxygenate feedstock, and additive source flow rates associated with making the fuel composition. The TNN 300 can determine the necessary adjustments to be made to the flow rates of one or more of straight run products stream, reformate feedstock, cracked gasoline source, polymerization feedstock, alkylate feedstock, hydrotreated feedstock, isomerate feedstock, oxygenate feedstock, and additive source by evaluating the fuel composition properties as they exist at the time the property data is generated. Operation of the TNN 300 is illustrated in FIG. 5.

The TNN 300 may receive input data from the delivery system 302 such as, for example, flow rates of straight run products stream 304, reformate feedstock 306, cracked gasoline source 308, polymerization feedstock 310, alkylate feedstock 312, hydrotreated feedstock 314, isomerate feedstock 316, oxygenate feedstock 318, and additive source 320 and/or the fuel composition properties from the controller 322. The TNN 300 processes the flow rate information and fuel composition property information and outputs a listing 324 including one or more adjustments to make to the one or more delivery system 302 flow rates. The listing 324 may then be transmitted to the controller 322 for implementation. The controller 322 may translate the listing information into informational commands and then may transmit those commands to the delivery system 302.

The TNN 300 may also function to detect property-adjustment implementation errors (not shown in FIG. 5). That is, the TNN 300 may be programmed to remember past listings 324 of adjustments made to the one or more delivery system flow rates to alter a given property. Therefore, if the TNN 300 receives input data (e.g., fuel composition property information) that does not reflect a flow rate adjustment which was previously commanded, then the TNN 300 outputs an error signal corresponding to the particular flow rate adjustment. For example, at time $T_5$, the TNN 300 receives input data relating to fuel composition property $S_5$ and the corresponding flow rates of straight run products stream 304, reformate feedstock 306, cracked gasoline source 308, polymerization feedstock 310, alkylate feedstock 312, hydrotreated feedstock 314, isomerate feedstock 316, oxygenate feedstock 318, and additive source 320. According to the fuel composition property $S_5$ and the flow rates, TNN 300 determines that the reformate feedstock 306 and alkylate feedstock 312 require downward adjustments. Information relating to these adjustments are transmitted to the controller 322 and then to the delivery system 302 for effective implementation. However, at time $T_6$, the input data associated with the reformate feedstock 306 flow rate indicates that the previous adjustment was not properly implemented (i.e., reformate feedstock 306 flow rate increased indicating an upward adjustment).

The generated error signal indicates the improper flow rate and alerts the system of the error and its source (e.g., reformate feedstock 306 flow rate). The TNN 300 may also be programmed to indicate the extent to which one or more delivery system 302 flow rates deviate from the prescribed adjustment(s). For example, the oxygenate feedstock 318 flow rate at time $T_6$ increased 1.5 times from its reading at time $T_5$. Thus, the TNN 300 has the capabilities to facilitate optimization of the fuel composition production process by prescribing flow rate adjustments and further by detecting internal adjustment implementation errors.

Many fuel compositions suitable for combustion in automotive spark-ignition engines conform to the requirements of ASTM D4814-89 specifications, which specifications are herein incorporated by reference in their entirety. These specifications may be employed as desirable properties obtainable by the systems and methods of the present invention. Such fuel compositions fall into five different volatility classes, with some of the specifications therefor set forth in the following Table 1. The methods and systems of the present invention may be employed to make fuel compositions having one or more of the properties of Table 1.

TABLE 1

| Properties | Class A | Class B | Class C | Class D | Class E |
|---|---|---|---|---|---|
| RVP psi max | 9.0 | 10.0 | 11.5 | 13.5 | 15.0 |
| RVP atm max | 0.6 | 0.7 | 0.8 | 0.9 | 1.0 |
| Dist 10% ° F. max | 158 | 149 | 140 | 131 | 122 |
| ° C. max | 70 | 65 | 60 | 55 | 50 |
| Dist 50% ° F. min-max | 170-250 | 170-245 | 170-240 | 170-235 | 170-230 |
| ° C. min-max | 77-121 | 77-118 | 77-116 | 77-113 | 77-110 |
| Dist 90% ° F. max | 374 | 374 | 365 | 365 | 365 |
| ° C. max | 190 | 190 | 185 | 185 | 185 |
| End Pt ° F. max | 437 | 437 | 437 | 437 | 437 |
| ° C. max | 225 | 225 | 225 | 225 | 225 |

Attempts to reduce harmful emissions from the combustion of fuel compositions are reflected in certain specifications for reformulated gasolines, developed by regulatory boards and Congress. One regulatory board is the California Air Resources Board (GARB) of the State of California. In 1991, specifications were developed by GARB for California gasolines which, based upon testing, should provide good performance and low emissions. The specifications and properties, of the reformulated gasoline, which is referred to as Phase 2 reformulated gasoline or California Phase 2 gasoline, are shown in Table 2 below. The methods and systems of the present invention may be employed to make fuel compositions having one or more of the properties of Table 2.

TABLE 2

Properties and specifications for Phase 2 Reformulated Gasoline

| Fuel Property | Units | Flat Limit | Averaging Limit | Cap Limit |
|---|---|---|---|---|
| RVP | psi, max. | 7.00[1] | | 7.00 |
| Sulfur | ppmw | 40 | 30 | 80 |
| Benzene | vol. %, max. | 1.00 | 0.80 | 1.20 |
| Aromatic HC | vol. %, max. | 25.0 | 22.0 | 30.0 |
| Olefin | vol. %, max. | 6.0 | 4.0 | 10.0 |
| Oxygen | wt. % | 1.8 (min)<br>2.2 (max) | | 1.8 (min)<br>2.7 (max)[2] |
| Dist 50% | ° F. | 210 | 200 | 220 |
| Dist 90% | ° F. | 300 | 290 | 330 |

[1]Applicable during the summer months identified in 13 CCR, sections 2262.1(a) and (b).
[2]Applicable during the winter months identified in 13 CCR, sections 2262.5(a).

In Table 2, as well as for the rest of the specification, the following definitions apply. Aromatic hydrocarbon content means the amount of aromatic hydrocarbons in the fuel composition expressed to the nearest tenth of a percent by volume in accordance with 13 CCR (California Codes of Regulations), section 2263. Benzene content means the amount of benzene contained in the fuel composition expressed to the nearest hundredth of a percent by volume in accordance with 13 CCR, section 2263. Olefin content means the amount of olefins in the fuel composition expressed to the nearest tenth of a percent by volume in accordance with 13 CCR, section 2263. Oxygen content means the amount of actual oxygen contained in the fuel composition expressed to the nearest tenth of a percent by weight in accordance with 13 CCR, section 2263. Potency-weighted toxics (PWT) means the mass exhaust emissions of benzene, 1,3-butadiene, formaldehyde, and acetaldehyde, each multiplied by their relative potencies with respect to 1,3-butadiene, which has a value of 1. Predictive model means a set of equations that relate emissions performance based on the properties of a particular fuel composition to the emissions performance of an appropriate baseline fuel. Sulfur content means the amount by weight of sulfur contained in the fuel composition expressed to the nearest part per million in accordance with 13 CCR, section 2263. Toxic air contaminants means exhaust emissions of benzene, 1,3-butadiene, formaldehyde, and acetaldehyde. The above mentioned features may be properties on which various amounts of components are mixed to form the fuel compositions in accordance with the present invention.

The flat limits must not be exceeded in any gallon of gasoline leaving the production facility. The averaging limits for each fuel property established in the regulations are numerically more stringent than the comparable flat limits for that property. Under the averaging option, a producer may assign differing "designated alternative limits" (DALs) to different batches of gasoline being supplied from a production facility. Each batch of gasoline must meet the DAL assigned for the batch. In addition, a producer supplying a batch of gasoline with a DAL less stringent than the averaging limit must, within 90 days before or after, supply from the same facility sufficient quantities of gasoline subject to more stringent DALs to fully offset the exceedances of the averaging limit. The cap limits are absolute limits that cannot be exceeded in any gallon of gasoline sold or supplied throughout the gasoline distribution system.

In the methods and systems of the present invention, the amount of fuel composition components are adjusted so that desirable properties are obtained. The properties and amount of individual components of a fuel composition dictate the level of pollutant emissions generated by the combustion of the fuel.

Generally speaking, in fuel compositions, as the 50% D-86 Distillation Point is progressively decreased, progressively greater reductions in CO and hydrocarbons emissions result; as the olefin content is progressively decreased, progressively greater reductions in NOx and hydrocarbons emissions result; as the paraffin content is progressively increased, progressively greater reductions in CO and NOx emissions result; as the Reid Vapor Pressure is progressively decreased, progressively greater reductions in NOx emissions result; as the Research Octane Number is progressively increased, progressively greater reductions in hydrocarbon emissions result; as the 10% D-86 Distillation Point is progressively decreased, progressively greater reductions in NOx emissions result; progressively increasing the paraffin content progressively decreases the CO emitted; progressively increasing the aromatics content progressively decreases the hydrocarbons emitted; and as the 90% D-86 Distillation Point is progressively decreased, progressively greater reductions in CO emissions result. And, of course, combining any of the above factors leads to yet progressively greater reductions. The system and methods of the present invention facilitate mitigating/reducing hydrocarbons, CO and NOx emissions.

In embodiments making fuel compositions where one particularly desires mitigating hydrocarbon emissions and/or CO emissions, a notable factor influencing such emissions is the 50% D-86 distillation point, with decreases therein causing decreases in the hydrocarbon emissions. Fuel compositions generally prepared in accordance with this embodiment of the invention have a 50% D-86 distillation point no greater than about 215° F., with the hydrocarbon and CO emissions progressively decreasing as the 50% D-86 distillation point is reduced below about 215° F. In another embodiment, fuel compositions have a 50% D-86 Distillation Point of about 205° F. or less. In yet another embodiment, fuel compositions have a 50% D-86 distillation point below about 195° F.

In embodiments making fuel compositions where one particularly desires mitigating emissions of NOx, a notable factor influencing such emissions is Reid Vapor Pressure. NOx emissions decrease as the Reid Vapor Pressure is decreased (e.g., to about 8.0 psi or less, or to about 7.5 psi or less, or below about 7.0 psi). Of secondary importance with respect to NOx emissions are the 10% D-86 Distillation Point and the olefin content. In general, decreasing olefin content (e.g., below 15 volume %, or to essentially zero volume %) and/or decreasing the 10% D-86 Distillation Point (e.g., to values below about 140° F.) provides some reduction in NOx emissions. In another embodiment, mitigating emissions of NOx occurs when both the olefin content is below about 15 volume % and the Reid Vapor Pressure is no greater than about 7.5 psi while maintaining the 10% D-86 Distillation Point below about 140° F.

In embodiments making fuel compositions where one particularly desires mitigating emissions of hydrocarbons, CO, and NOx, the 50% D-86 distillation point is maintained at or below about 215° F. and the Reid Vapor Pressure is maintained no greater than about 8.0 psi. In another embodiment, the olefin content is maintained below about 10 volume %, or the 10% D-86 distillation point is maintained below about 140° F., with still further reductions possible when both the olefin content and 10% D-86 Distillation Point are so maintained. In yet another embodiment, the 50% D-86 distillation point is maintained below about 195° F., the olefin content is maintained below about 5 vol. %, the 10% D-86 Distillation Point is maintained below about 120° F., and/or the Reid Vapor Pressure is maintained below about 7.0 psi.

In one embodiment, the system and method of the present invention provides a fuel composition having the following properties: Olefin Content of about 0%; Reid Vapor Pressure of about 7.5 psi or less; and a 50% D-86 distillation point greater than 180° F. and less than 205° F.

In embodiments where the aromatic content, 50% D-86 Distillation Point and 90% D-86 Distillation Point properties are all relatively high, a lower sulfur content and/or a lower olefin content are desired.

Specific examples of fuel composition properties include: Olefin Content of about 0%; Reid Vapor Pressure of about 7.5 psi or less; 50% D-86 distillation point greater than about 180° F. and less than about 205° F.; 50% D-86 distillation point no greater than about 215° F. and a Reid Vapor Pressure no greater than about 8.0 psi; 50% D-86 distillation point no greater than about 205° F. and an olefin content less than about 3% by volume; a Reid Vapor Pressure no greater than about 8.0 psi and containing at least 40 volume % paraffins; a Reid Vapor Pressure no greater than about 7.5 psi and containing essentially no methyl tertiary butyl ether but less than 15 volume % olefins; a Research Octane Number of at least about 90, such as from about 90 to about 100; concentration of lead no greater than about 0.05 gram of lead per gallon (unleaded fuel), and an anti-knock value (R+M)/2 of at least about 87 (or at least about 92).

In one embodiment, the fuel compositions made in accordance with the present invention contain substantially no oxygenates, have a Reid Vapor Pressure of about 7.5 psi or less, a sulfur content less than about 30 ppmw. In another embodiment, the fuel compositions made in accordance with the present invention contain substantially no oxygenates, have a Reid Vapor Pressure of about 7.5 psi or less, a sulfur content less than about 30 ppmw, and an olefin content of about 8 volume % or less. In this particular embodiment, the low olefin content is believed to enhance the beneficial effects of the low sulfur. In yet another embodiment, the fuel compositions made in accordance with the present invention contain substantially no oxygenates, have a Reid Vapor Pressure of about 7.5 psi or less, a sulfur content less than about 30 ppmw, an olefin content of about 8 volume % or less, and the aromatic hydrocarbon content is greater than 30 volume %.

In another embodiment, an unleaded fuel composition is substantially free of oxygenates, has a Reid vapor pressure of less than about 7.5 psi, a sulfur content of less than 30 ppmw, an olefin content of about 8 volume % or less, and a 90% D-86 Distillation Point greater than about 330° F. In yet another embodiment, an unleaded fuel composition is substantially free of oxygenates, has a Reid vapor pressure of less than about 7.5 psi, a sulfur content of less than about 20 ppmw, an olefin content of about 5 volume % or less and a 50% D-86 Distillation Point greater than about 220° F.

Fuel compositions produced by the systems and/or methods of the present invention may be used without further processing, or they may be combined with other components to form further refined compositions. In this connection, the fuel compositions produced by the systems and/or methods of the present invention may constitute a component of a further refined fuel composition, typically from about 0.01% by weight to about 99.99% by weight of the further refined fuel composition.

The pollutants addressed by the foregoing specifications and mitigated by many embodiments of the present invention include oxides of nitrogen (NOx) and hydrocarbons which are generally measured in units of gm/mile, and potency-weighted toxics (PWT), which are generally measured in units of mg/mile.

The fuel compositions produced in accordance with the present invention are useful in operating internal combustion engines, such as automotive vehicles having a spark-ignited. The fuel compositions are further useful in trnasportation vehicles such airplanes, jets, helicopters, snowmobiles, ATVs, motorcycles, and boats, 2-stroke engines, generators, and the like. The fuels are introduced into the engine and then combusted in the engine. The resulting emissions are then discharged from the vehicle exhaust system to the atmosphere. Most of the emissions are inert, non-harmful components, with the regulated components such as hydrocarbons and NOx being low.

The fuel compositions of the present invention are particularly applicable to gasoline fueled cars, particularly those equipped with a catalytic converter, and to vehicles certified to California Low Emission Vehicle (LEV) standards, Transitional Low Emissions Vehicle (TLEV) standards, Phase 2 LEV standards (LEV II), and U.S. Environmental Protection Agency National Low Emissions Vehicle (NLEV) standards.

The "D-86 Distillation Point" herein refers to the distillation point obtained by the procedure identified as ASTM D 86-82, which can be found in the 1990 Annual Book of ASTM Standards, Section 5, Petroleum Products, Lubricants, and Fossil Fuels, is hereby incorporated by reference in its entirety.

"Reid Vapor Pressure" is a pressure determined by a conventional analytical method for determining the vapor pressure of petroleum products. In essence, a liquid petroleum sample is introduced into a chamber, then immersed in a bath at 100° F. until a constant pressure is observed. Thus, the Reid Vapor Pressure is the difference, or the partial pressure, produced by the sample at 100° F. The complete test procedure is reported as ASTM test method D 323-89 in the 1990 Annual Book of ASTM Standards, Section 5, Petroleum Products, Lubricants, and Fossil Fuels, is hereby incorporated by reference in its entirety.

Research Octane Number can be determined using the procedure set forth in ASTM D 2699, which is hereby incorporated by reference in its entirety.

It is to be understood in this disclosure and the claims to follow that the words "reduce" and "reducing" in the context of lowering NOx, CO, or hydrocarbon emissions are relative terms. For example, for those embodiments of the invention in which the 50% D-86 Distillation Point is controlled to no more than 200° F., the emissions are typically reduced in comparison to the otherwise identical fuel but having a higher 50% D-86 Distillation Point when combusted in the same automotive engine operating for the same time period in the same way.

In one embodiment, the systems and/or methods of the present invention provide fuel compositions having low emissions, good performance, but substantially free of oxygenates thereby avoiding some of the concerns with oxygenates in fuels. In one embodiment, the fuel compositions made in accordance with the present invention contain substantially no oxygenates. By substantially no oxygenates, it is meant that the gasoline formulation contains less than at least one weight percent oxygen, or preferably less than 0.5 weight percent oxygen, and most preferably substantially zero weight percent oxygen. In another embodiment, the fuel compositions made in accordance with the present invention contain oxygenates.

In one embodiment, the present invention can provide fuel compositions from which relatively small amounts of gaseous pollutants, and in particular one or more of NOx, CO, and hydrocarbons, are produced during combustion in an automotive engine. In this connection, the invention can also provide methods of combusting such fuel compositions in automotive engines while minimizing the emission of pollutants released to the atmosphere, which in turn provides methods for reducing air pollution. The present invention can provide a petroleum refiner with an automated system and method to produce a gasoline fuel which reduces or minimizes NOx, CO, and hydrocarbon emissions upon combustion in an automotive engine.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for making a fuel composition having reduced emissions of one or more of CO, NOx, and hydrocarbons upon combustion, comprising:

identifying two or more predetermined properties of the fuel composition for measurement and control;

charging one or more hydrocarbon feedstock, one or more oxygenate feedstock, and one or more additives into a blending tank to make a fuel composition mixture, each of the one or more hydrocarbon feedstock, one or more oxygenate feedstock, and one or more additive feed having a first charge rate;

determining amounts of each of the one or more hydrocarbon feedstock, the one or more oxygenate feedstock, and the one or more additives charged into the blending tank to make the fuel composition mixture;

determining two or more current properties of the fuel composition mixture in the blending tank, the two or more current properties of the fuel composition mixture corresponding to the two or more predetermined properties of the fuel composition;

comparing the predetermined properties of the fuel composition with the current properties of the fuel composition mixture using a processor coupled to a memory, the memory comprising historical information relating to amounts and identities of fuel composition components and corresponding fuel composition properties; and adjusting the charge rate of at least one of the one or more hydrocarbon feedstocks, one or more oxygenate feedstocks, and one or more additives to a second charge rate into the blending tank in response to the amounts of each of the one or more hydrocarbon feedstocks, the one or more oxygenate feedstocks, and the one or more additives charged into the blending tank and comparing the predetermined properties and the current properties to provide the fuel composition having reduced emissions of one or more of CO, NOx, and hydrocarbons upon combustion, wherein adjusting the charge rate is performed using feedback control and the processor, the processor operative to determine adjustments to the charge rate of at least one of the one or more hydrocarbon feedstocks, one or more oxygenate feedstocks, and one or more additives into the blending tank based upon the current properties of the fuel composition mixture and the historical information relating to amounts and identities of fuel composition components and corresponding fuel composition properties.

2. The method of claim 1, wherein the fuel composition has reduced emissions of CO upon combustion.

3. The method of claim 1, wherein the fuel composition has reduced emissions of NOx upon combustion.

4. The method of claim 1, wherein the processor executes program code stored in the memory.

5. The method of claim 2, wherein the two or more predetermined properties of the fuel composition comprise a 50% D-86 distillation point and the paraffin content, and adjusting the charge rate of at least one of the one or more hydrocarbon feedstocks, one or more oxygenate feedstocks, and one or more additives to the second charge rate into the blending tank decreases the 50% D-86 Distillation Point and increases the paraffin content to provide the fuel composition having reduced emissions of CO upon combustion.

6. The method of claim 3, wherein the two or more predetermined properties of the fuel composition comprise Reid Vapor Pressure and 10% D-86 Distillation Point, and adjusting the charge rate of at least one of the one or more hydrocarbon feedstocks, one or more oxygenate feedstocks, and one or more additives to the second charge rate into the blending tank decreases the Reid Vapor Pressure and the 10% D-86 Distillation Point to provide the fuel composition having reduced emissions of NOx upon combustion.

7. The method of claim 1, wherein the fuel composition has reduced emissions of hydrocarbons upon combustion.

8. The method of claim 7, wherein the two or more predetermined properties of the fuel composition comprise olefin content and Research Octane Number, and adjusting the charge rate of at least one of the one or more hydrocarbon feedstocks, one or more oxygenate feedstocks, and one or more additives to the second charge rate into the blending tank decreases the olefin content and increases the Research Octane Number to provide the fuel composition having reduced emissions of hydrocarbons upon combustion.

9. A method for making a fuel composition having reduced emissions of CO or NOx upon combustion, comprising:

identifying two or more predetermined properties of the fuel composition for measurement and control;

charging one or more hydrocarbon feedstock, optionally one or more oxygenate feedstock, and optionally one or more additives into a blending tank to make a fuel composition mixture, each of the one or more hydrocarbon feedstock, one or more oxygenate feedstock, and one or more additive feed having a first charge rate;

determining amounts of each of the one or more hydrocarbon feedstock, the one or more oxygenate feedstock, and the one or more additives charged into the blending tank to make the fuel composition mixture;

determining two or more current properties of the fuel composition mixture in the blending tank, the two or more current properties of the fuel composition mixture corresponding to the two or more predetermined properties of the fuel composition;

comparing the predetermined properties of the fuel composition with the current properties of the fuel composition mixture using a programmable logic circuit coupled to a memory, the memory comprising historical information relating to amounts and identities of fuel composition components and corresponding fuel composition properties; and adjusting the charge rate of at least one of the one or more hydrocarbon feedstocks, one or more oxygenate feedstocks, and one or more additives to a second charge rate into the blending tank in response to the amounts of each of the one or more hydrocarbon feedstocks, the one or more oxygenate feedstocks, and the one or more additives charged into the blending tank and comparing the predetermined properties and the current properties to provide the fuel composition having reduced emissions of CO or NOx upon combustion, wherein adjusting the charge rate is performed using feedback control and the programmable logic circuit, the programmable logic circuit operative to determine adjustments to the charge rate of at least one of the one or more hydrocarbon feedstocks, one or more oxygenate feedstocks, and one or more additives into the blending tank based upon the current properties of the fuel composition mixture and the historical information relating to amounts and identities of fuel composition components and corresponding fuel composition properties.

10. The method of claim 9, wherein the fuel composition has reduced emissions of CO upon combustion.

11. The method of claim 9, wherein the fuel composition has reduced emissions of NOx upon combustion.

12. The method of claim 9, wherein the programmable logic circuit executes program code stored in the memory.

13. The method of claim 10, wherein the two or more predetermined properties of the fuel composition comprise a 50% D-86 distillation point and the paraffin content, and adjusting the charge rate of at least one of the one or more hydrocarbon feedstocks, one or more oxygenate feedstocks, and one or more additives to the second charge rate into the blending tank decreases the 50% D-86 Distillation Point and increases the paraffin content to provide the fuel composition having reduced emissions of CO upon combustion.

14. The method of claim 11, wherein the two or more predetermined properties of the fuel composition comprise Reid Vapor Pressure and 10% D-86 Distillation Point, and adjusting the charge rate of at least one of the one or more hydrocarbon feedstocks, one or more oxygenate feedstocks, and one or more additives to the second charge rate into the blending tank decreases the Reid Vapor Pressure and the 10%

D-86 Distillation Point to provide the fuel composition having reduced emissions of NOx upon combustion.

15. The method of claim 9, wherein the memory further comprises historical, information relating to effects on fuel composition properties as a result of adding one or more fuel composition components thereto.

16. A method for making fuel composition having reduced emissions of CO or NOx upon combustion in an automobile engine, comprising:

identifying two or more predetermined properties of the fuel composition for measurement and control;

charging one or more hydrocarbon feedstock and an ethanol feedstock into a blending tank to make a fuel composition mixture, each of the one or more hydrocarbon feedstock and the ethanol feedstock having a first charge rate;

determining amounts of each of the one or more hydrocarbon feedstock and the ethanol feedstock charged into the blending tank to make the fuel composition mixture;

determining two or more current properties of the fuel composition mixture in the blending tank, the two or more current properties of the fuel composition mixture corresponding to the two or more predetermined properties of the fuel composition;

comparing the predetermined properties of the fuel composition with the current properties of the fuel composition mixture using a processor coupled to a memory, the memory comprising historical information relating to amounts and identities of fuel composition components and corresponding fuel composition properties; and adjusting the charge rate of at least one of the one or more hydrocarbon feedstocks and the ethanol feedstock to a second charge rate into the blending tank in response to the amounts of each of the one or more hydrocarbon feedstock and the ethanol feedstock charged into the blending tank and comparing the predetermined properties and the current properties to provide the fuel composition having reduced emissions of CO or NOx upon combustion, wherein adjusting the charge rate is performed using feedback control and the processor, the processor operative to determine adjustments to the charge rate of at least one of the one or more hydrocarbon feedstocks and the ethanol feedstock into the blending tank based upon the current properties of the fuel composition mixture and the historical information relating to amounts and identities of fuel composition components and corresponding fuel composition properties.

17. The method of claim 16, wherein the fuel composition has reduced emissions of CO upon combustion.

18. The method of claim 16, wherein the fuel composition has reduced emissions of NOx upon combustion.

19. The method of claim 17, wherein the two or more predetermined properties of the fuel composition comprise a 50% D-86 distillation point and the paraffin content, and adjusting the charge rate of at least one of the one or more hydrocarbon feedstocks and the ethanol feedstock to the second charge rate into the blending tank decreases the 50% D-86 Distillation Point and increases the paraffin content to provide the fuel composition having reduced emissions of CO upon combustion.

20. The method of claim 18, wherein the two or more predetermined properties of the fuel composition comprise Reid Vapor Pressure and 10% D-86 Distillation Point, and adjusting the charge rate of at least one of the one or more hydrocarbon feedstocks and the ethanol feedstock to the second charge rate into the blending tank decreases the Reid Vapor Pressure and the 10% D-86 Distillation Point to provide the fuel composition having reduced emissions of NOx upon combustion.

* * * * *